US009470491B1

(12) United States Patent
Ginetto et al.

(10) Patent No.: US 9,470,491 B1
(45) Date of Patent: Oct. 18, 2016

(54) FRANGIBLE TAIL BOOM FOR PROJECTILE

(71) Applicants: Stephen Ginetto, Carlstadt, NJ (US); Andrew Moramarco, Staten Island, NY (US); Leanne Mohla, Blairstown, NJ (US)

(72) Inventors: Stephen Ginetto, Carlstadt, NJ (US); Andrew Moramarco, Staten Island, NY (US); Leanne Mohla, Blairstown, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 224 days.

(21) Appl. No.: 14/496,150

(22) Filed: Sep. 25, 2014

(51) Int. Cl.
*F42B 10/14* (2006.01)

(52) U.S. Cl.
CPC ..... *F42B 10/14* (2013.01)

(58) Field of Classification Search
CPC ..... F42B 10/14
See application file for complete search history.

(56) References Cited

U.S. PATENT DOCUMENTS 2,801,586 A * 8/1957 Mongello ..... F41A 33/00 102/372
2,968,245 A * 1/1961 Sutton ..... F42B 10/30 102/377
3,007,410 A * 11/1961 Blacker ..... F42B 15/00 102/380
4,291,627 A * 9/1981 Ziemba ..... F42C 9/148 102/211
5,080,017 A * 1/1992 Asikainen ..... F42B 30/10 102/285
5,452,864 A * 9/1995 Alford ..... F42B 10/26 244/3.23
5,762,291 A * 6/1998 Hollis ..... F42B 10/50 244/3.21
6,779,463 B2 * 8/2004 Mutascio ..... F42B 12/46 102/373
7,150,235 B1 * 12/2006 Mikhail ..... F42B 10/06 102/518
8,434,394 B1 * 5/2013 Malejko ..... F42B 10/14 102/374
8,624,171 B2 * 1/2014 Frey, Jr. ..... F42B 10/06 244/3.1
8,735,789 B1 * 5/2014 Malejko ..... F42B 10/06 244/3.24

* cited by examiner

*Primary Examiner* — Justin Benedik
(74) *Attorney, Agent, or Firm* — Michael C. Sachs

(57) ABSTRACT

A frangible tail boom for a gun-launched projectile includes a tail boom housing having a forward end configured to engage a projectile body and a through bore. The tail boom housing has forward and rear portions. The forward portion has a frusto-conical shape and an outer diameter that decreases from the forward end toward the rear portion. The forward portion includes a circumferential groove extending from the outer surface radially inward toward the small diameter segment of the through bore.

20 Claims, 7 Drawing Sheets

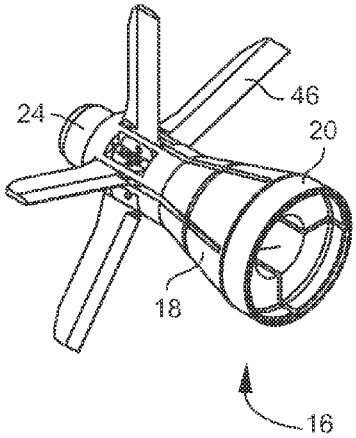
Fig. 6
Fig. 7
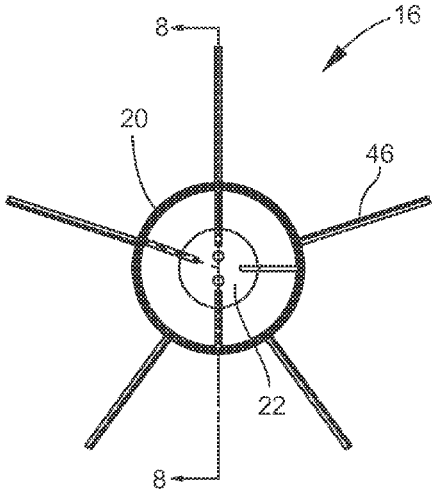
Fig. 9
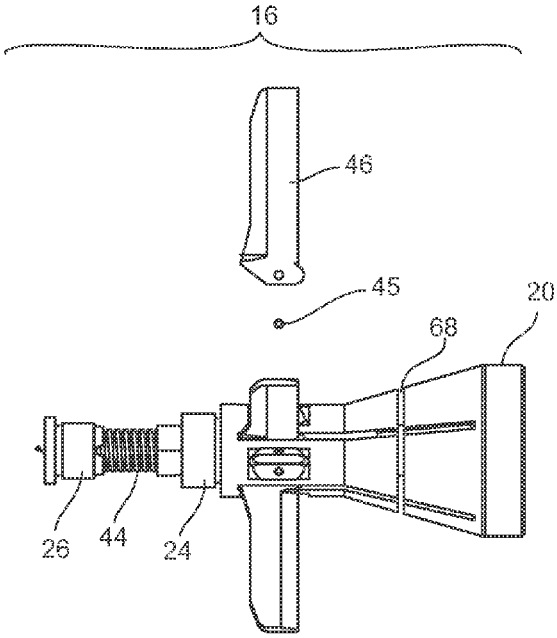

FRANGIBLE TAIL BOOM FOR PROJECTILE

STATEMENT OF GOVERNMENT INTEREST

The inventions described herein may be manufactured, used and licensed by or for the United States Government.

BACKGROUND OF THE INVENTION

The invention relates in general to gun-launched projectiles and in particular to stabilizing fins for gun-launched projectiles.

Fins and tail booms are well-known for stabilizing the flight of non-spinning gun launched projectiles. In a large caliber gun, high projectile velocities are obtained. The fins attached to the tail boom of a high velocity projectile do not interfere with target penetration by the projectile. The fin and tail boom are typically rigid, robust structures designed to withstand gun launch.

The fins may be attached to the tail boom using, for example, pins, screws, rivets, etc. In the gun tube, the fins are folded down. Upon muzzle exit, the fins unfold to their deployed position. The deployed fins stabilize the projectile during flight. In high velocity projectiles, the projectile penetrates the target after impact. Projectiles with relatively low velocity, such as those fired from multi-target shoulder fired weapons, have less kinetic energy than higher velocity projectiles. The consumption of kinetic energy caused by breaking the fins on a lower kinetic energy projectile can inhibit the complete penetration of a projectile in a target. That is, the low velocity of the projectile is not sufficient to overcome the robust design of the fin and boom assembly. In some cases, the warhead function is rendered useless if the projectile does not penetrate the target.

A need exists for a tail boom for a low velocity projectile that breaks apart from the projectile upon target impact to enable the low velocity projectile to penetrate the target with little resistance.

SUMMARY OF INVENTION

One aspect of the invention is a frangible tail boom for a gun-launched projectile. The tail boom includes a tail boom housing having a central longitudinal axis, a forward end configured to engage a projectile body and a through bore. The tail boom housing includes a forward portion and a rear portion. The forward portion has the general shape of a conical frustum. An outer diameter of the forward portion decreases from the forward end toward the rear portion. The through bore in the forward portion includes a large diameter segment and a small diameter segment located rearward of the large diameter segment. The forward portion includes a circumferential groove extending from an outer surface radially inward toward the small diameter segment of the through bore.

The circumferential groove may have a depth equal to at least one half a radius of the conical frustum at the groove.

The tail boom may include a cap fixed to a rear end of the boom housing. The cap may include an outer cylindrical portion that engages a surface of the through bore in the housing and an inner cylindrical portion having a bore therein.

A piston may be centered on the central longitudinal axis and translatable in the through bore in the boom housing. The piston has a forward curved surface and a stem that extends rearward. The stem is translatable in and engages a surface of the bore of the inner cylindrical portion of the cap.

A compression spring may be disposed around the inner cylindrical portion of the cap. One end of the compression spring bears on the piston and the other end of the compression spring bears on the cap to bias the piston in a forward direction.

A plurality of fins may be rotatably fixed to the boom housing. Each fin includes a protruding portion that extends into a forward translation path of the piston in a stowed position of the fins.

In a deployed position of the fins, each fin may include a planar portion parallel to the central longitudinal axis of the boom housing.

The piston may include a cylindrical surface that adjoins the forward curved surface.

In the deployed position of the fins, the planar portion of each fin may abut the cylindrical surface of the piston.

The through bore of the tail boom housing may include a chamfer that reduces a diameter of the through bore to less than a diameter of the piston. The chamfer may be located at an end of the forward translation path of the piston.

The tail boom housing may include, for each of the plurality of fins, a stop surface that is angled with respect to the central longitudinal axis.

Another aspect of the invention is a gun-launched projectile having the novel tail boom.

In another aspect of the invention, a method includes providing a projectile having a novel tail boom and then launching the projectile. The projectile impacts a target. After impact, the tail boom is fractured at a circumferential groove and the tail boom breaks away from the projectile.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 6 is a perspective view of the tail boom of FIG. 1 with the fins in a deployed position.

FIG. 7 is a front end view of the tail boom of FIG. 6.

FIG. 9 is a partially exploded side view of the tail boom of FIG. 6.

DETAILED DESCRIPTION

Figure 1:
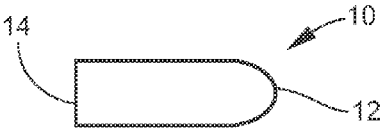
Fig. 1 PRIOR ART
FIG. 1 is a schematic of one embodiment of a projectile.
Figure 3:
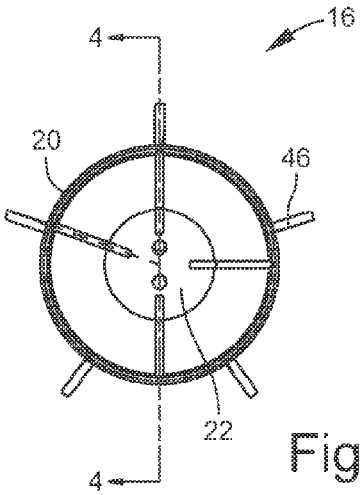
FIG. 3 is a front end view of the tail boom of FIG. 2.
Figure 2:
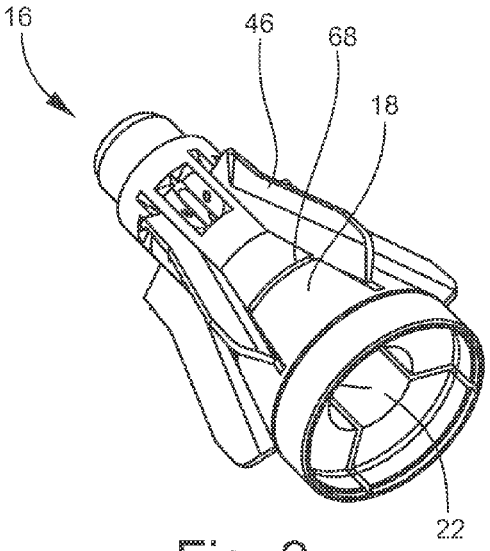
FIG. 2 is a perspective view of one embodiment of a tail boom with fins in a stowed position.
Figure 5:
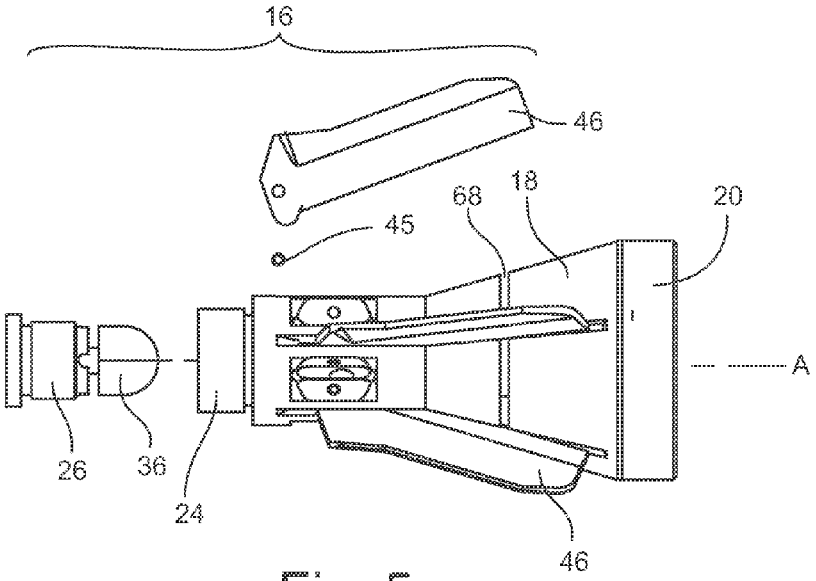
FIG. 5 is a partially exploded side view of the tail boom of FIG. 1.
Figure 4:
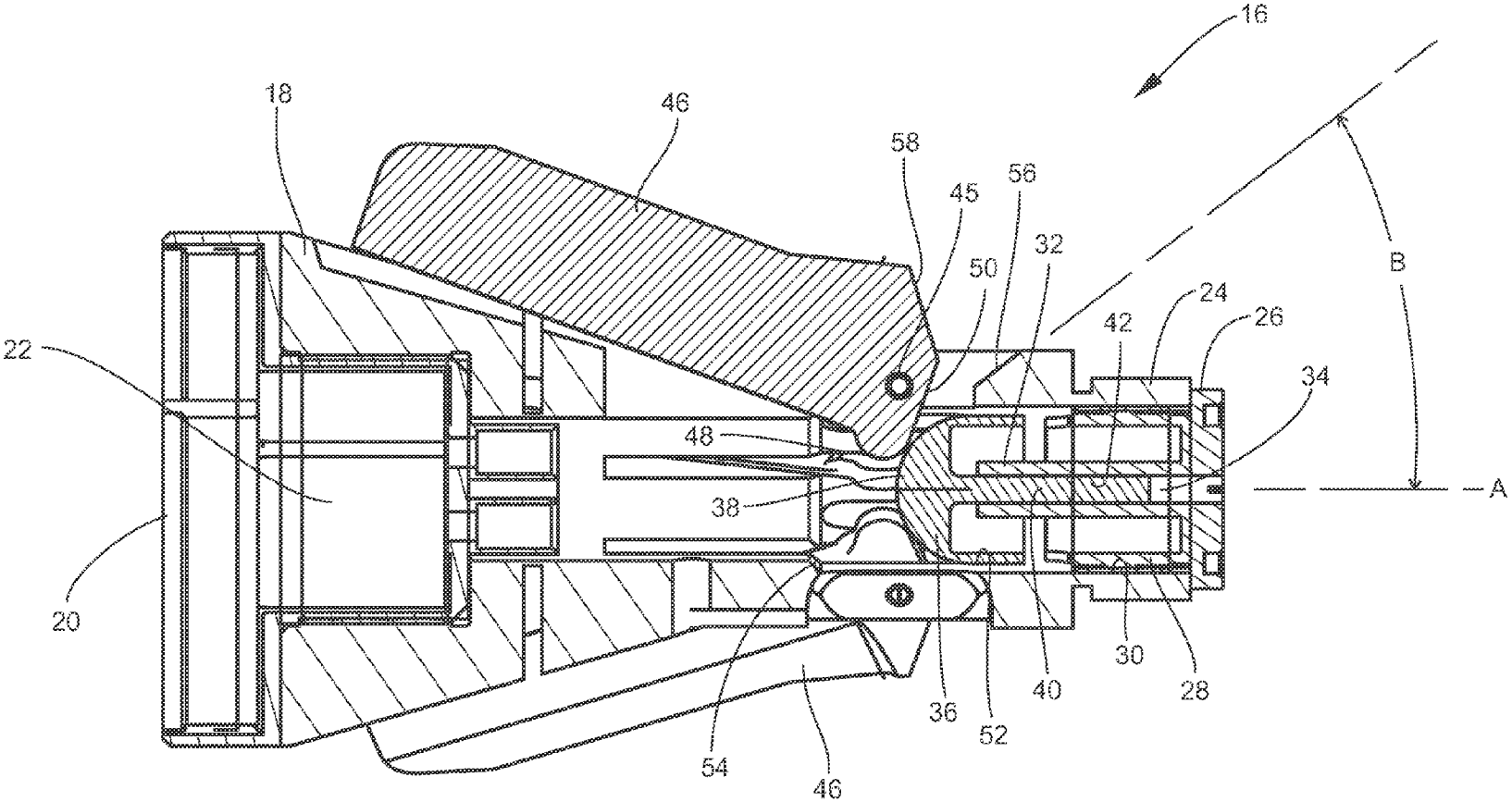
FIG. 4 is a sectional view taken along the line 4-4 of FIG. 3.
Figure 8:
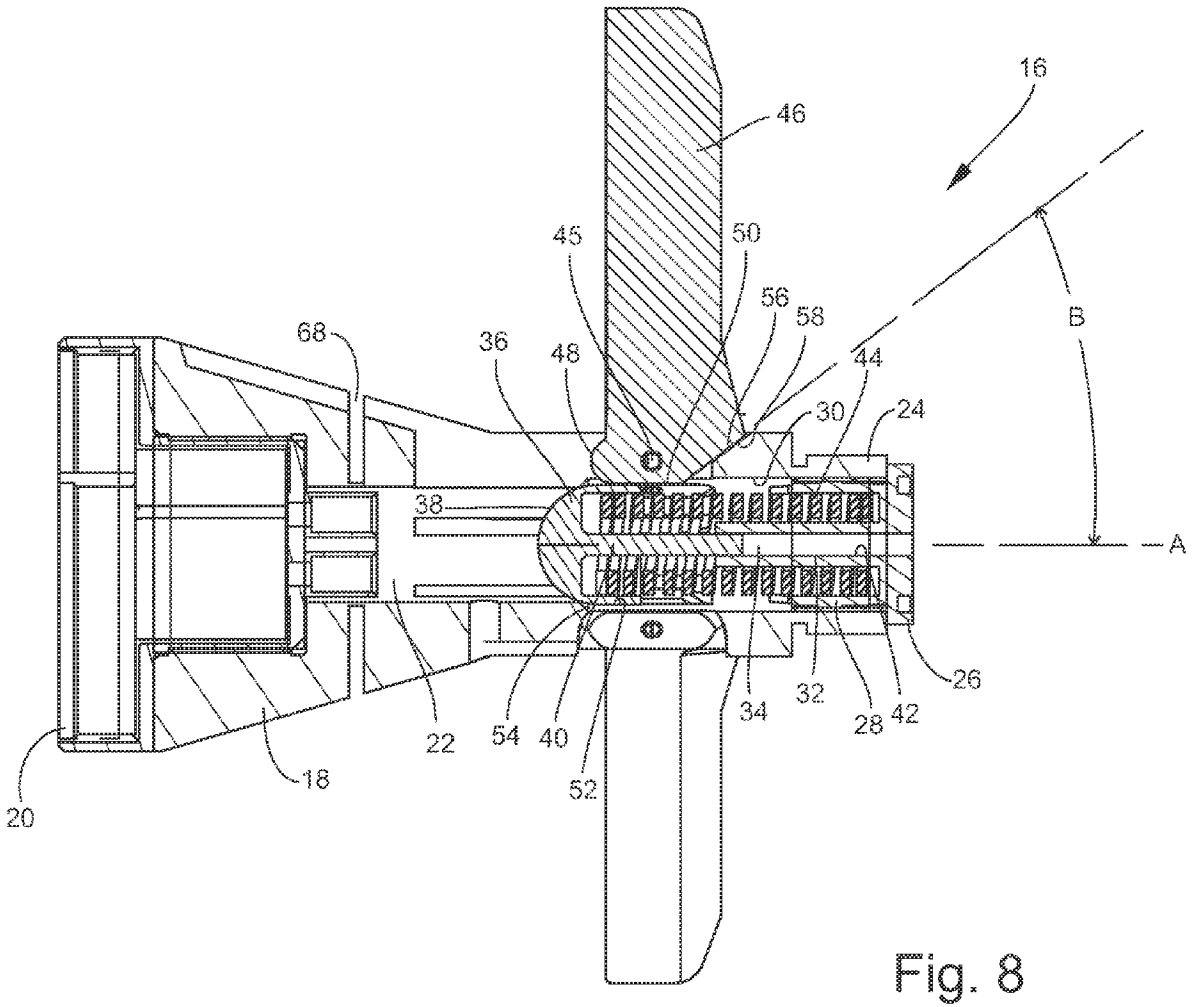
FIG. 8 is a sectional view taken along the line 8-8 of FIG. 7.
Figure 10A:
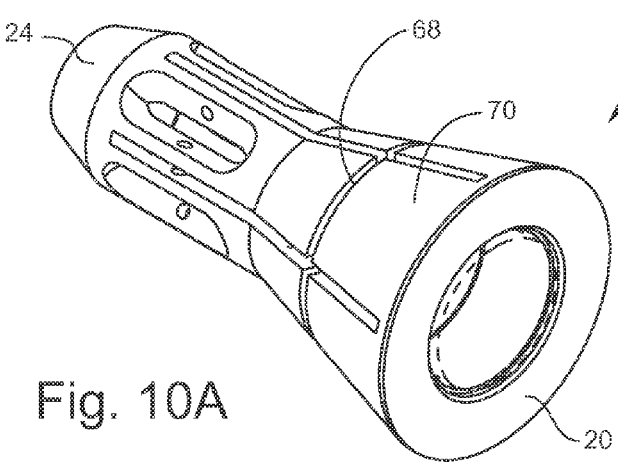
FIGS. 10A and 10B are perspective and front end views, respectively, of one embodiment of a tail boom housing.
Figure 10B:
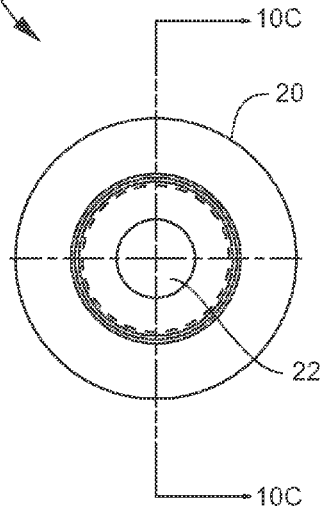
Figure 10D:
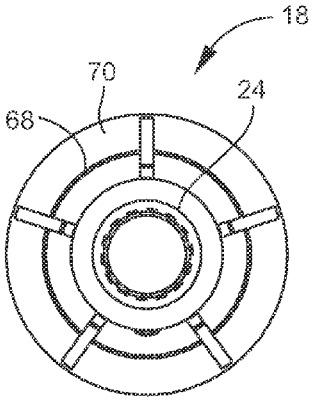
FIG. 10D is a rear end view of the tail boom housing of FIG. 10A.
Figure 10C:
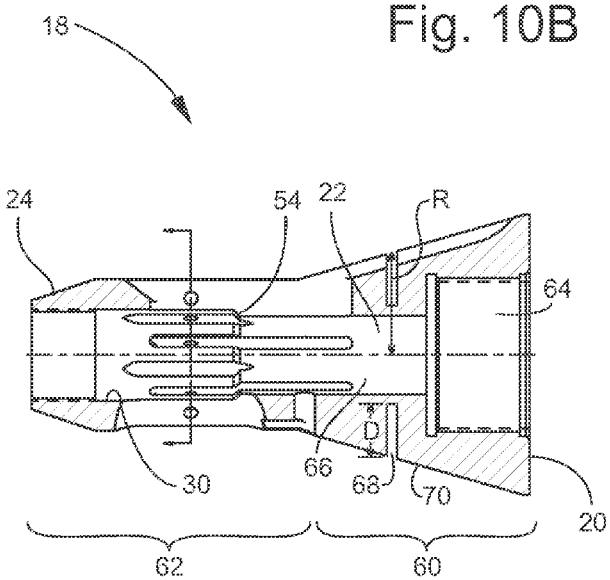
FIG. 10C is a sectional view taken along the line 10C-10C of FIG. 10B.

FIG. 1 is a schematic of one embodiment of a projectile 10. Projectile 10 includes a nose end 12 and a rear end 14.

A tail boom having deployable fins may be fixed to the rear end 14 of projectile 10 to stabilize its flight. The caliber of projectile 10 may vary, for example, from about 40 mm to 100 mm or larger. When fitted with the novel tail boom disclosed herein, projectile 10 may be launched from a variety of gun tubes and weapons. For example, projectile 10 may be launched from a single use, shoulder-fired munition. The novel tail boom is advantageous for use with low velocity projectiles because the tail boom breaks apart from the projectile upon target impact to enable the velocity projectile to penetrate the target with little resistance.

Figure 12A:
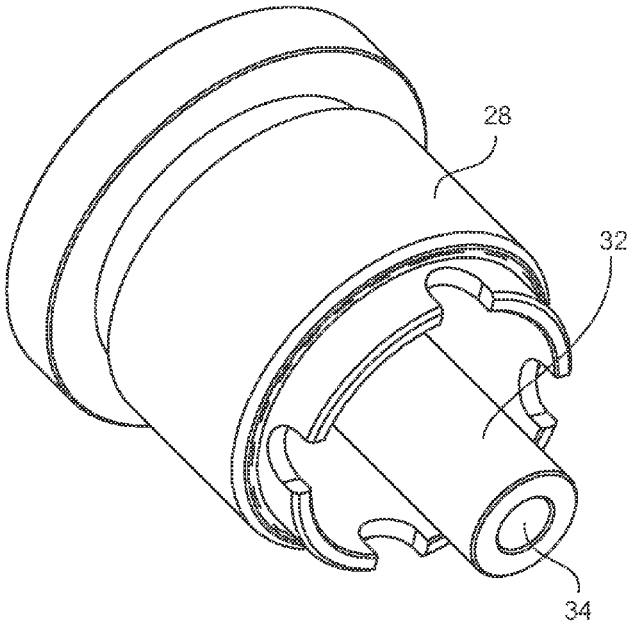
FIGS. 12A, 12B and 12C are perspective, front end, and sectional views of one embodiment of a cap.
Figure 12B:
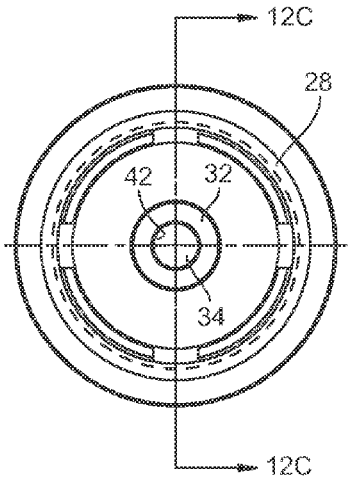
Figure 12C:
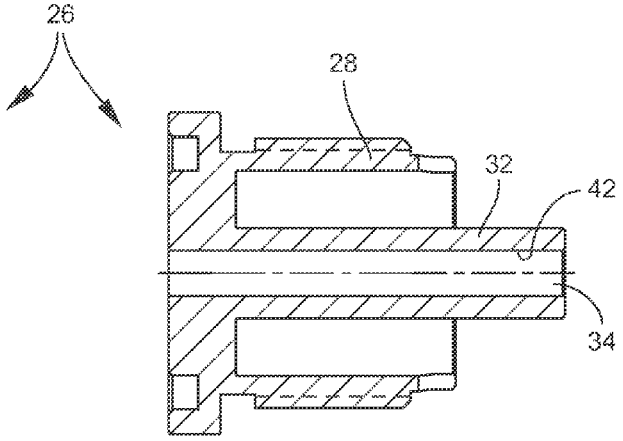

FIGS. 2-5 show one embodiment of a novel tail boom 16 with fins 46 in the stowed position. FIGS. 6-9 show tail boom 16 with fins 46 in the deployed position. Tail boom 16 includes a frangible boom housing 18 having a central longitudinal axis A. The frangible boom housing 18 only is shown in detail in FIGS. 10A-D. A forward end 20 of housing 18 is configured to engage and be fixed to the rear end 14 of a projectile 10. Housing 18 has a through bore 22. A cap 26 is fixed to a rear end 24 of the boom housing 18. Cap 26 only is shown in detail in FIGS. 12A-C. Cap 26 includes an outer cylindrical portion 28 that engages a surface 30 of the through bore 22 in the housing 18. Cap 26 includes an inner cylindrical portion 32 having a bore 34 therein.

Figure 11A:
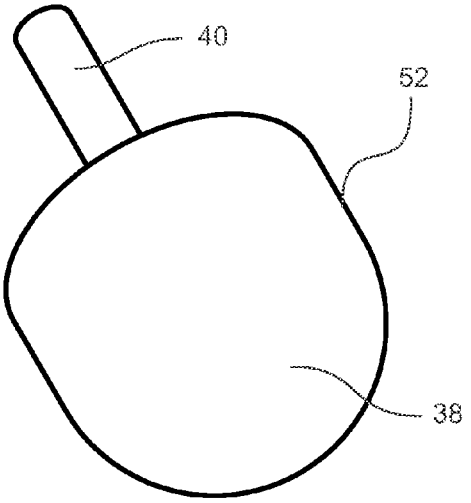
FIGS. 11A, 11B and 11C are perspective, front end, and sectional views of one embodiment of a piston.
Figure 11B:
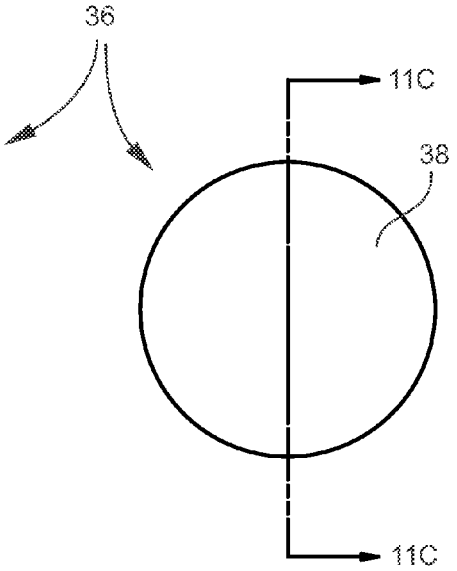
Figure 11C:
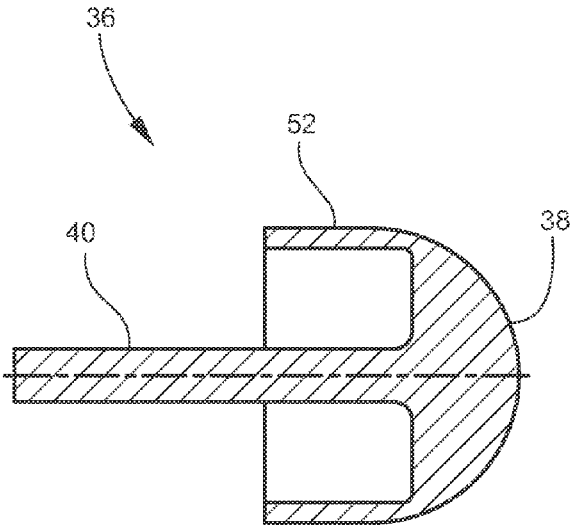

A piston 36 is centered on the central longitudinal axis A. The piston 36 only is shown in detail in FIGS. 11A-C. Piston 36 is translatable in the through bore 22 in the boom housing 18. The piston 36 has a forward curved surface 38. Surface 38 may have a hemispherical shape. A stem 40 extends rearward from surface 38. Stem 40 is translatable in and engages a surface 42 of the bore 34 of the inner cylindrical portion 32 of the cap 26. A compression spring 44 (not shown in FIG. 4, see FIG. 8) is disposed around the inner cylindrical portion 32 of the cap 26. One end of the compression spring 34 bears on the piston 36 and the other end of the compression spring 34 bears on the cap 26. Spring 34 biases piston 36 in a forward direction toward forward end 20 of housing 18.

A plurality of fins 46 are rotatably fixed to the boom housing 18. Fins may be fixed to housing 18 with fin pins 45. Five fins 46 are shown in the Figs., but the number of fins 46 may vary. Each fin 46 includes a protruding portion 48 that extends into a forward translation path of the piston 36, in the stowed position of the fins 46 (FIGS. 2-5). In the disclosed embodiment, the protruding portion 48 of each fin 46 that extends into the forward translation path of the piston 36 is a curved portion. In the deployed position of the fins 46 (FIGS. 6-9), each fin 46 includes a planar portion 50 that is parallel to the central longitudinal axis A of the boom housing 18.

The piston 36 includes a cylindrical surface 52 that adjoins the forward curved surface 38. In the deployed position of the fins 46 (FIGS. 6-9), the planar portion 50 of each fin 46 abuts the cylindrical surface 52 of the piston 36. At the forward end of the piston's translation path, the through bore surface 30 includes a chamfer 54. Chamfer 54 reduces the diameter of through bore 22 to a diameter less than the diameter of piston 36.

The tail boom housing 18 includes, for each of the plurality of fins 46, a stop surface 56 that forms an angle B with respect to the central longitudinal axis A. In the deployed position of the fins 46, a trailing portion 58 of each fin 46 abuts its respective stop surface 56.

The boom housing 18, cap 26, fins 46 and piston 36 may be made of, for example, aluminum alloy.

Prior to insertion in a launch tube, the fins 46 may be held in the stowed position (folded forward as in FIGS. 2-5) by a cord, strap, or wire (not shown) of suitable material for handling purposes. After the projectile 10 with tail boom 16 is inserted in the launch tube, the cord is cut and the launch tube maintains the fins 46 in the stowed position. The fins 46 remain in the stowed position until muzzle exit. For single use, shoulder-fired munitions, the projectile 10 may be loaded in the launch tube as part of the manufacturing process.

When projectile 10 with tail boom 16 exits the muzzle of the launch tube, compression spring 44 translates piston 36 in the forward direction. Piston 36 is guided by the surface 30 of through bore 22 and the stem 40 that translates in bore 34 of cap 26. Piston 36 presses against protruding portions 48 of fins 46, thereby deploying all the fins 46 simultaneously and with equally distributed force. The fins 46 stop against the angled stop surfaces 56 on the tail boom housing 18. Angled stop surfaces 56 reduce the transmission of the impact forces to the fin base through the fin hinge pin.

The piston 36 continues to translate forward in through bore 22 until piston 36 stops against chamfer 54. The combination of the geometry of chamfer 54 and forward curved surface 38 of piston 36 creates a force fit between the piston 36 and the boom housing 18, thereby fixing the piston 36 in place. In addition, the continued force from the spring 44 biases the piston 36 into chamfer 54, thereby maintaining the position of the piston 36. Thus, the piston 36 maintains the deployed position of the fins 46. The cylindrical surface 52 of piston 36 abuts the planar portion 50 of the fins to prevent the fins 50 from returning to the stowed position.

The use of a single spring 44 for fin deployment enables the fins 46 to deploy simultaneously with equal force. The contoured stop surface 56 for the fins 46 redirects the impact forces to preserve fin integrity. The chamfer 54 maintains piston position and fin deployment with no added parts. The single spring 44 provides a constant and well-defined deployment event, as compared to gas-operated pistons. The through bore surface 30 and the stem 40 disposed in bore 34 prevent piston 36 from jamming or becoming cocked during fin deployment. The mating surfaces of the piston 36 and chamfer 54 are interference surfaces that render the piston 36 stuck at the end of its travel.

Referring to FIGS. 10A-D, the frangible tail boom housing 18 has a forward portion 60 and a rear portion 62. The forward portion 60 has the general shape of a conical frustum. The outer diameter of the forward portion 60 decreases from the forward end 20 toward the rear portion 62. The through bore 22 in the forward portion 60 has a large diameter segment 64 and a small diameter segment 66. The small diameter segment 66 is located rearward of the large diameter segment 64. The forward portion 60 includes a circumferential groove 68. Groove 68 extends from an outer surface 70 radially inward toward the small diameter segment 66 of the through bore 22. In one embodiment, the circumferential groove 68 has a depth D (FIG. 10C) equal to at least one half a radius R of the conical frustum at the groove 68. Groove 68 is located forward of the fins 46.

The grooved section of the tail boom housing 18 survives gun launch but fails when the projectile 10 impacts a target. As the projectile 10 impacts and penetrates the target, the fins 46 contact the target and break the grooved section of the boom housing 18 so that the tail boom 16 separates from the projectile 10. The low velocity projectile 10 is free to continue penetrating the target. The frangible tail boom housing 18 enables low velocity projectiles to be more effective against hard targets.

When the projectile 10 impacts the target with no obliquity, the fins 46 impact the target surface and cause tensile failure at the section of groove 68 of the boom housing 18. When the projectile 10 impacts the target with higher obliquity, the inertia of the fin hub causes the grooved section to break in bending as the projectile nose 12 strikes the target.

During testing, the novel tail boom housing 18 withstood gun launch and projectile flight. The housing 18 discarded upon impact of projectile 10 with the target so that the projectile 10 was able to fully penetrate the target.

While the invention has been described with reference to certain embodiments, numerous changes, alterations and modifications to the described embodiments are possible without departing from the spirit and scope of the invention as defined in the appended claims, and equivalents thereof.

What is claimed is:

1. A frangible tail boom for a gun-launched projectile, comprising:

a tail boom housing having a central longitudinal axis, a forward end configured to engage a projectile body and a through bore;

the tail boom housing having a forward portion and a rear portion, the forward portion having the general shape of a conical frustum, an outer diameter of the forward portion decreasing from the forward end toward the rear portion;

the through bore in the forward portion including a large diameter segment and a small diameter segment located rearward of the large diameter segment;

the forward portion including a circumferential groove extending from an outer surface radially inward toward the small diameter segment of the through bore wherein after the projectile impacts a target the tail boom is designed to fracture at the circumferential groove.

2. The tail boom of claim 1, wherein the circumferential groove has a depth equal to at least one half a radius of the conical frustum at the groove.

3. The tail boom of claim 1, further comprising:

a cap fixed to a rear end of the boom housing, the cap including an outer cylindrical portion that engages a surface of the through bore in the housing and an inner cylindrical portion having a bore therein;

a piston centered on the central longitudinal axis and translatable in the through bore in the boom housing, the piston having a forward curved surface and a stem that extends rearward, the stem being translatable in and engaging a surface of the bore of the inner cylindrical portion of the cap;

a compression spring disposed around the inner cylindrical portion of the cap, one end of the compression spring bearing on the piston and the other end of the compression spring bearing on the cap to bias the piston in a forward direction; and a plurality of fins rotatably fixed to the boom housing, each fin including a protruding portion that extends into a forward translation path of the piston in a stowed position of the fins.

4. The tail boom of claim 3, wherein the forward curved surface of the piston is a hemispherical surface.

5. The tail boom of claim 3, wherein the protruding portion of each fin that extends into the forward translation path of the piston is a curved portion.

6. The tail boom of claim 5, wherein, in a deployed position of the fins, each fin includes a planar portion parallel to the central longitudinal axis of the boom housing.

7. The tail boom of claim 6, wherein the piston includes a cylindrical surface that adjoins the forward curved surface.

8. The tail boom of claim 7, wherein, in the deployed position of the fins, the planar portion of each fin abuts the cylindrical surface of the piston.

9. The tail boom of claim 8, wherein the through bore of the tail boom housing includes a chamfer that reduces a diameter of the through bore to less than a diameter of the piston, the chamfer being located at an end of the forward translation path of the piston.

10. The tail boom of claim 9, wherein the tail boom housing includes, for each of the plurality of fins, a stop surface that is angled with respect to the central longitudinal axis.

11. The tail boom of claim 10, wherein, in the deployed position of the fins, a trailing portion of each fin abuts the stop surface.

12. A gun-launched projectile including the tail boom of claim 1.

13. A method, comprising:

providing a projectile having the tail boom of claim 1;

launching the projectile;

impacting a target with the projectile;

fracturing the tail boom at the circumferential groove; and breaking the tail boom away from the projectile.

14. A tail boom for a gun-launched projectile, comprising:

a tail boom housing having a central longitudinal axis, a forward end for engaging a projectile body and a central through bore;

the tail boom housing having forward and rear portions, the forward portion configured in the shape of a conical frustum, an outer diameter of the forward portion decreasing from the forward end toward the rear portion;

the through bore in the forward portion including a first segment and a second segment, the first segment having a larger diameter than the second segment;

the forward portion including a circumferential groove extending from an outer surface radially inward toward the small diameter segment of the through bore wherein the circumferential groove has a depth equal to at least one half a radius of the conical frustum at the groove.

15. The tail boom of claim 14, further comprising:

a cap fixed to a rear end of the boom housing, the cap including an outer cylindrical portion that engages a surface of the through bore in the housing and an inner cylindrical portion having a bore therein;

a piston centered on the central longitudinal axis and translatable in the through bore in the boom housing, the piston having a forward curved surface and a stem that extends rearward, the stem being translatable in and engaging a surface of the bore of the inner cylindrical portion of the cap;

a compression spring disposed around the inner cylindrical portion of the cap, one end of the compression spring bearing on the piston and the other end of the compression spring bearing on the cap to bias the piston in a forward direction; and a plurality of fins rotatably fixed to the boom housing, each fin including a protruding portion that extends into a forward translation path of the piston in a stowed position of the fins.

16. The tail boom of claim 15, wherein the protruding portion of each fin that extends into the forward translation path of the piston is a curved portion.

17. The tail boom of claim 16, wherein, in a deployed position of the fins, each fin includes a planar portion parallel to the central longitudinal axis of the boom housing.

18. The tail boom of claim 17, wherein the piston includes a cylindrical surface that adjoins the forward curved surface.

19. The tail boom of claim 18, wherein, in the deployed position of the fins, the planar portion of each fin abuts the cylindrical surface of the piston.

20. A gun-launched projectile including the tail boom of claim 19.

* * * * *